US005941423A

United States Patent [19]

Racault et al.

[11] Patent Number: 5,941,423

[45] Date of Patent: Aug. 24, 1999

[54] APPARATUS FOR THE APPLICATION OF A NON-SOLID PRODUCT

[75] Inventors: Andre Racault, Saint Sulpice; Jerome Machet, Blois, both of France

[73] Assignee: Societe de Prospection et d'Inventions Techniques (S.P.I.T.), Bourg-les-Valence, France

[21] Appl. No.: 08/903,150

[22] Filed: Jul. 30, 1997

[30] Foreign Application Priority Data

Jul. 30, 1996 [FR] France ..... 96 09564

[51] Int. Cl.[6] ..... B67D 5/52

[52] U.S. Cl. ..... 222/137; 222/327

[58] Field of Search ..... 222/137, 333, 222/327

[56] References Cited

U.S. PATENT DOCUMENTS 4,249,677 2/1981 Davis, Jr. .

4,681,524 7/1987 Ikeda et al. .

4,840,294 6/1989 Ernst .

5,207,357 5/1993 Aronie et al. .

FOREIGN PATENT DOCUMENTS 0 563 486 6/1993 France .

*Primary Examiner*—Gregory L Huson

*Attorney, Agent, or Firm*—Schwartz & Weinrieb

[57] ABSTRACT

Apparatus comprising a housing (1) for receiving at least one storage cartridge for the product with a rear thrust wall for the product, a thrust piston (2), a drive comprising a front sprocket (5) for driving the piston (2) by friction, actuated by an intermediate feed rod (6) driven by a motor (3) in a reciprocating motion, and a control lever (4). The drive is adapted to effect any desired application of the product by a single actuation of the control lever (4).

14 Claims, 2 Drawing Sheets

APPARATUS FOR THE APPLICATION OF A NON-SOLID PRODUCT

FIELD OF THE INVENTION

This invention relates to an apparatus for the application or dispensing of a non-solid, in particular a viscous product, from a storage cartridge for the product mounted on the apparatus. A cartridge of this kind may comprise an outer envelope or container provided on one side with an end piece intended to receive an applicator nozzle and on the other side with a base wall intended to slide towards the end piece and expel the product from the end piece and the nozzle.

BACKGROUND OF THE INVENTION

Apparatus or guns of this kind are generally used for the application of sealants for thermal and/or sound insulation.

The base wall of a cartridge is intended to slide as a result of the feed of a piston actuated manually with the aid of a pump lever by means of a rack and pinion or friction feed mechanism.

One known mechanism with a friction feed rod—U.S. Pat. No. 4,840,294—includes a front feed sprocket and a rear non-return sprocket mounted on the rod, each extending in a plane substantially perpendicular to the latter.

The feed sprocket is intended to engage the piston rod by movably pivoting over the rod as a result of the pumping of the lever in order to drive the piston towards the front in an elementary feed motion and to disengage the non-return sprocket already engaging the rod after completion of a pumping operation so as to, thereby block the piston in order to prevent it from moving backwards.

The application of a predetermined quantity of the product from the cartridge requires a certain feed of the piston resulting from a plurality of successive pumping operations.

In short, using an apparatus of this kind, an operator must tire himself out pumping a great many times in order to apply his product.

OBJECTS OF THE INVENTION

This invention proposes a new apparatus for the application of a non-solid product, aiming firstly to reduce the physical effort required by the operator in order to apply the product.

SUMMARY OF THE INVENTION

To this end, the invention relates to an apparatus for the application of a non-solid product, comprising means for receiving at least one storage cartridge for the product with a rear thrust wall for the product, a thrust piston, means for driving the piston, and a control lever for the drive means, characterised in that the drive means is adapted to effect any desired application of the product by means of a single actuation of the control lever and comprises an intermediate feed rod adapted to be actuated in a reciprocating movement and to drive the thrust piston towards the front during the forward motion.

By virtue of the invention, the operator simply has to actuate the lever once and maintain his action in order to pump and apply the product.

In this case, the drive means may include:

- a front sprocket for driving the thrust piston by friction, actuated by the intermediate feed rod, and
- a rotating cam for driving the intermediate feed rod, driven by a motor started by the control lever.

Means are advantageously, and in this case always provided for stopping the motor only at the end of the return motion of the intermediate feed rod.

The intermediate feed rod also advantageously includes a flexion zone adapted to actuate an emergency stop switch for the motor as a result of flexure of the intermediate feed rod.

Once again in the preferred embodiment, in addition to a rear non-return sprocket cooperating by friction with the thrust piston, an intermediate non-return rod is provided between the control lever and the non-return sprocket.

In this case, the non-return rod is very advantageously mounted to pivot at the front on a pin integral with the control lever, and at the rear, on the side of the non-return sprocket the non-return rod is mounted to move with two degrees of freedom about a rear guide pin.

In this case with, the control lever being mounted to move about an axis of rotation, the rear guide pin of the non-return rod, the pivot pin of the non-return rod on the control lever, and the axis of rotation of the control lever are adapted to be aligned upon actuation of the control lever.

The force applied to the thrust piston towards the rear is consequently no longer applied to the control lever itself, that is the hand of the operator, but to its axis of rotation integral with the casing of the apparatus.

The non-return rod also preferably includes a rear port extended by a groove in which the rear guide pin is received and through which the non-return sprocket extends.

In this case, the rear port of the non-return rod and the non-return sprocket are adapted so that the cooperation of the non-return sprocket and the thrust piston is interrupted when the control lever is not actuated.

The thrust piston can consequently be pulled towards the rear in a simple manner, for example, in order to change the cartridge.

BRIEF DESCRIPTION OF THE DRAWINGS

The invention will be more readily understood with the aid of the following description of the preferred embodiment of the apparatus of the invention for the application of a non-solid product with reference to the accompanying drawings, in which like reference characters designate like or corresponding parts throughout the several views, and wherein.

DETAILED DESCRIPTION OF THE PREFERRED EMBODIMENT

Figure 1:
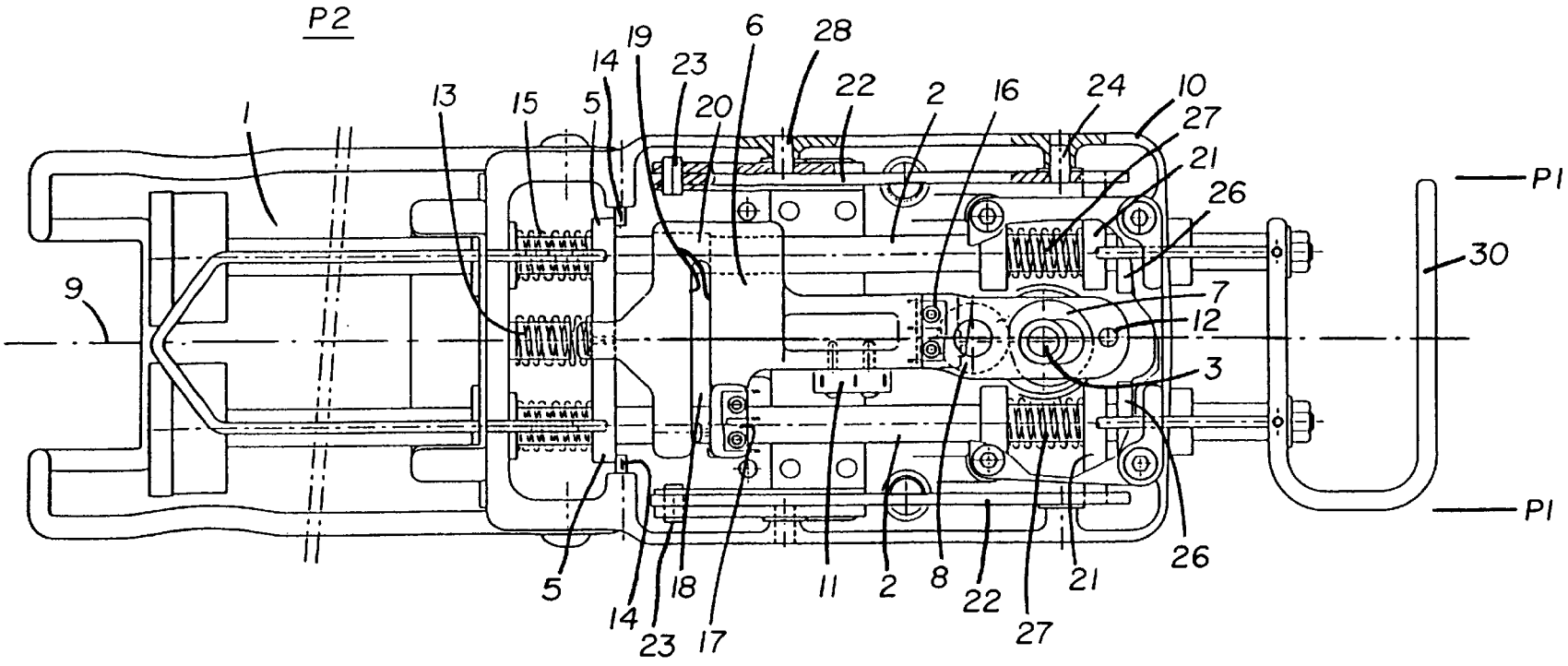
FIG. 1 is a sectional top view of the preferred embodiment of the apparatus.
Figure 2:
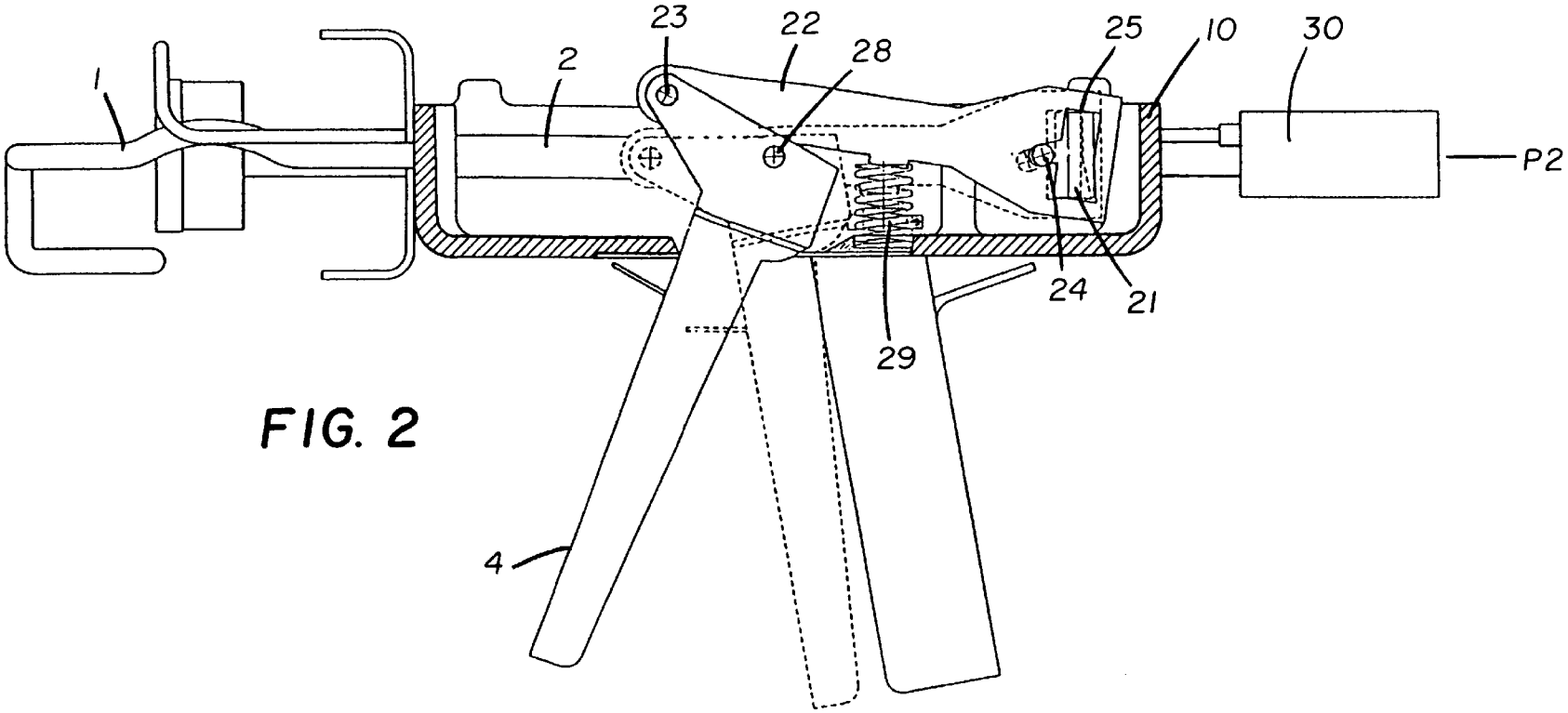
FIG. 2 is a sectional side view of the apparatus of FIG. 1.

The preferred embodiment of the apparatus which will now be described can receive two storage cartridges respectively containing two non-solid products to be mixed together prior to their application.

The applicator comprises, in a casing 10:

- a front housing 1 for receiving the two storage cartridges, each having a rear thrust wall for their contents;
- two thrust pistons 2 for the rear cartridge walls;
- a mechanism for driving the pistons 2 towards the front;
- a motor 3 for actuating the drive mechanism (represented by its output shaft);
- a non-return mechanism for the pistons 2, and
- a control lever 4 for controlling the motor 3 and actuating the non-return mechanism.

The two pistons 2 are parallel with one another and symmetrical relative to a longitudinal axis 9 of symmetry of the drive and non-return mechanisms.

The drive mechanism includes:

two front sprockets 5 for friction feeding of the two thrust pistons 2 respectively, an intermediate feed rod 6, for actuating the front sprockets 5, extending along the axis 9, a rotating cam 7 for driving the intermediate feed rod 6 towards the front, mounted on the output shaft of the motor 3, and a thrust roller 8 mounted to rotate on the intermediate feed rod 6 and in contact with the cam 7 on its periphery at the rear.

The two front sprockets 5 mounted on their respective pistons 2 at the front extend in a plane substantially perpendicular to the axis 9.

Each front sprocket 5 bears on one side against the front end of the intermediate feed rod 6 by the action of a return spring 13 described hereinafter and on the opposite side against a rear stop 14 integral with the casing 10 by the action of a front sprocket spring 15 surrounding the piston 2 at the front of the front sprocket 5 and fixed in position in the casing 10 at its front end.

In the rest position of the front sprockets 5, the thrust pistons 2 can slide across the front sprockets 5 adapted to tilt slightly towards their respective pistons from their rest position perpendicular to the axis 9 to an inclined blocking position in which the relative sliding of the front sprockets 5 and their respective pistons 2 is blocked.

The intermediate return spring 13 of the feed rod 6 extending along the axis 9 is held in the casing 10 by its front end and bears against the front of the intermediate feed rod 6 via its rear end and by means of the front sprockets 5.

The non-return mechanism comprises two rear non-return sprockets 21 mounted like the front sprockets 5, but on the rear parts of the two respective pistons 2 and intended to prevent the thrust pistons 2 from moving backwards between two elementary feed motions of the latter, as will be described in the description of the operation of the apparatus.

In the respective thrust rest position of the applicator, each rear sprocket 21 bears against a ring 26 mounted around the piston 2 at the rear of the rear sprocket 21 by the action of a rear sprocket spring 27 fixed to the casing 10 and surrounding the respective thrust piston 2 in front of the rear sprocket 21. The rear sprockets 21 extend in one common plane substantially perpendicular to the axis 9 and can pivot towards their respective pistons 2 between a rest position perpendicular to the piston axis and a blocking position inclined relative to this axis and reached by actuating non-return rods described hereinafter. In the rest position of the rear sprockets 21, the thrust pistons 2 can slide across their rear sprockets 21 and, in the blocking position, the thrust pistons 2 are blocked in translation towards the rear by the rear sprockets 21.

Let $P_2$ be the plane of FIG. 1 containing the axes of the pistons 2. The two intermediate non-return rods 22 for actuating the two rear sprockets 21 respectively extend in the vicinity of their respective pistons 2 in two lateral planes P1 perpendicular to the plane P2. The rear part of each rod 22 defines a port 25 through which the rear sprocket 21 of the adjacent piston 2 extends.

The non-return rods 22 are mounted at the front so as to pivot about two respective pivot pins 23 integral with the control lever 4 and at the rear are movable with two degrees of freedom (in translation parallel to the axis 9 and pivoting) respectively about two guide pins 24 integral with the casing 10.

The control lever 4 is mounted to pivot about an axis of rotation 28 integral with the casing 10 and is held in the rest position by return springs 29 fixed to the casing 10.

The guide pins 24 and the axis of rotation 28 extend in the plane P2. The pivot pins 23 are movable between a rest position and an operating position reached by actuating the lever 4. In the rest position, the pivot pin 23 of each of the rods 22 is outside the plane P2 on the side not containing the control lever 4 and, in the operating position, is contained in the plane P2, the pivot pins 23 and guide pins 24 of each non-return rod 22 and the axis of rotation 28 of the lever 4 then being aligned in the extension plane P1 of this rod 22.

The applicator moreover comprises a switch 11 for starting the motor 3 situated in the vicinity of the axis 9 and the control lever 4, a final stop switch 16 for the motor 3 carried by the intermediate feed rod 6 close to the thrust wheel 8, and an emergency stop switch 17 for the motor 3 disposed toward a slot 18 formed in the front part of the intermediate feed rod 6.

The slot 18 has two inner faces 19 disposed opposite one another and perpendicular to the axis 9 and connected together by one single side forming a flexion zone 20 provided so that the two faces 19 can pivot towards one another and actuate the emergency stop switch 17.

A forcing pin 12 integral with the intermediate feed rod 6 is disposed in the rear vicinity of the cam 7 in order to force back the rod 6 by the action of the cam 7 in the intermediate feed descending phase, as will be described hereinafter.

The applicator finally includes a rear lever 30, for driving the thrust pistons 2 manually towards the rear, mounted on the rear ends of the pistons 2.

In view of the foregoing description of the structure of the applicator, its operation will now be described.

In order to apply a desired quantity of the mixture of the products contained in the storage cartridges received in the housing 1, the control lever 4 is actuated by pivoting it, in this case, towards the rear about its axis of rotation 28.

The pivoting of the control lever 4 results in pivoting and feeding of the two non-return rods 22 against the action of the return springs 29 until the pivot pins 23, the axis of rotation 28 and the guide pins 24 are aligned with one another. The displacement resulting from that of the ports 25 leads to pivoting and slight feeding of the rear non-return sprockets 21 to their blocking position, backward movement by the pistons 2 then being impossible.

Moreover, when the control lever 4 pivots, it actuates the switch 11 for starting the motor 3. When moving, the motor 3 drives the rotating cam 7, which pushes the intermediate feed rod 6 towards the front in a forward motion during an ascending phase by means of the thrust roller 8 rotating and advancing along the axis 9 simultaneously, the feed of the rod 6 being effected against the action of the return spring 13.

During the feed of the rod 6, the front sprockets 5 pivot from their rest position to their blocking position and drive their respective thrust pistons 2 in an elementary feed motion, the feed of the thrust pistons 2 pivoting the rear sprockets 21 slightly so that they leave their blocking position.

During their elementary feed motion, the pistons 2 push the rear walls of the cartridges towards the thrust front, an elementary quantity of the mixture of products thus being ejected from the cartridges.

The cam 7 then begins a descending phase during which it stops driving the feed rod 6 towards the front.

As a result of the action of the rear sprocket springs 27, the rear sprockets 21 pivot once again until they reach a new position for blocking the pistons 2, thereby preventing the same from moving backwards.

As a result of the action of the return spring 13, the feed rod 6 begins a return motion until it reaches its initial position and the front sprockets 5 simultaneously pivot once again until they reach their rest position.

After the descending phase, the cam 7 begins a new ascending phase resulting in another elementary feed motion of the thrust pistons 2.

During normal operation of the apparatus, and as long as the control lever 4 remains actuated, the ascending and descending phases of the cam 7 are followed by driving of the motor 3, the feed rod 6 being actuated in a reciprocating motion and driving the thrust pistons 2 towards the front during the forward motion. The application of the desired quantity of the mixture therefore results from a series of elementary applications.

After the total desired application of the products, actuation of the control lever 4 is stopped. The action of the return springs 29 drives the non-return rods 22 and the control lever 4 into their respective initial rest positions, the displacement of the rods freeing the rear sprockets 21, which pivot until they reach their initial rest positions.

At the end of the return motion of the intermediate feed rod 6 following the end of the actuation of the lever 4, the final stop switch 16 carried by the rod 6 is actuated during the movement of the rod 6 and the motor 3 stops.

During operation and above all in the case of the non-return of the feed rod 6, for example, as a result of the abnormal operation of the return spring 13, the cam 7 in the descending phase drives the forcing pin 12 towards the rear, thereby forcing back the intermediate feed rod 6.

Finally, if the feed rod 6 is prevented from feeding at the front, for example, as a result of a cartridge whose contents have solidified, the flexion zone 20 of the rod 6 yields and the two inner faces 19 of the intermediate feed rod 6 defining the slot 18 move towards one another, optionally until the emergency stop switch 17 for the motor 3 is actuated.

In the preceding description, the drive means comprise a single front sprocket for driving each thrust piston by friction.

A plurality of front sprockets for driving each thrust piston mounted side by side on the piston could also be provided for increasing the surface of friction between the front sprockets and the piston.

Obviously, many modifications and variations of the present invention are possible in light of the above teachings. It is therefore to be understood that within the scope of the appended claims, the present invention may be practiced otherwise than as specifically described herein.

We claim:

1. Apparatus for the dispensing of a non-solid product, comprising:

means for receiving at least one storage cartridge, having a rear thrust wall, within which a product to be dispensed is stored;

at least one thrust piston for acting upon said rear thrust wall of said at least one storage cartridge;

a motor drive shaft;

cyclically moving means mounted upon said motor drive shaft for cyclically driving said at least one thrust piston in a forward direction so as to dispense a predetermined amount of said product from said at least one storage cartridge; and control lever means, movable between an inoperative position and an operative position, for actuating said motor drive shaft and said cyclically moving piston driving means mounted upon said motor drive shaft such that in response to a single actuation of said control lever means, wherein said control lever means is moved from said inoperative position to said operative position, and maintenance of said control lever means at said operative position, said cyclically moving piston driving means drives said at least one thrust piston in said forward direction so as to dispense a predetermined amount of said product from said at least one storage cartridge.

2. The apparatus as set forth in claim 1, wherein:

said means for receiving said at least one storage cartridge, having a product stored therein and which is adapted to be dispensed therefrom, comprises means for receiving two storage cartridges having two different products stored therein and adapted to be mixed together when said two different products are to be dispensed; and said at least one thrust piston comprises a pair of thrust pistons disposed parallel to each other.

3. The apparatus as set forth in claim 2, wherein said piston driving means comprises:

front sprocket means operatively associated with said at least one thrust piston for alternatively engaging and disengaging said at least one thrust piston so as to cyclically feed said at least one thrust piston in said forward direction; and rear sprocket means operatively associated with said at least one thrust piston for alternatively engaging and disengaging said at least one thrust piston so as to cyclically permit forward movement of said at least one thrust piston in said forward direction by said front sprocket means and to prevent retrograde movement of said at least one thrust piston in a rearward direction.

4. The apparatus as set forth in claim 3, wherein said piston driving means further comprises:

a drive motor;

rotary cam means operatively connected to said drive motor; and an intermediate feed rod operatively associated with said rotary cam means and said front sprocket means.

5. The apparatus as set forth in claim 4, further comprising:

first switch means connected to said drive motor and operatively connected to said control lever means for activating said drive motor when said control lever means is moved from said inoperative position to said operative position; and second switch means connected to said drive motor and mounted upon said intermediate feed rod for deactivating said drive motor when said intermediate feed rod is moved rearwardly in conjunction with the movement of said control lever means from said operative position to said inoperative position upon completion of a dispensing operation.

6. The apparatus as set forth in claim 5, further comprising:

flexure zone means defined upon said intermediate feed rod for undergoing flexure when said intermediate feed rod is unable to drive said at least one thrust piston in said forward direction; and third switch means connected to said drive motor and mounted upon said intermediate feed rod at a position adjacent to said flexure zone means for deactivating said drive motor when said intermediate feed rod experiences flexure within said flexure zone means.

7. The apparatus as set forth in claim 3, further comprising:

non-return rod means for interconnecting said control lever means and said rear sprocket means.

8. The apparatus as set forth in claim 7, wherein:

said non-return rod means is pivotally connected at a forward end portion thereof to said control lever means by a first pivot pin means, and is mounted at a rear end portion thereof by a second guide pin means for permitting said non-return rod means to undergo movements in two degrees of freedom.

9. The apparatus as set forth in claim 8, further comprising:

third pivot pin means for pivotally mounting said control lever means upon said receiving means wherein said first pivot pin means, said second guide pin means, and said third pivot pin means are aligned with respect to each other when said control lever means is moved from said inoperative position to said operative position.

10. The apparatus as set forth in claim 8, further comprising:

first spring biasing means interposed between said receiving means and said non-return rod means for biasing said control lever means toward said inoperative position as a result of said pivotal connection of said non-return rod means to said control lever means.

11. The apparatus as set forth in claim 9, further comprising:

first spring biasing means interposed between said receiving means and said non-return rod means for biasing said control lever means toward said inoperative position about said third pivot pin means as a result of said pivotal connection of said non-return rod means to said control lever means by said first pivot pin means.

12. The apparatus as set forth in claim 7, wherein:

said front sprocket means comprises a pair of front sprockets respectively operatively associated with said pair of thrust pistons; rear sprocket means comprises a pair of rear sprockets respectively operatively associated with said pair of thrust pistons; and said non-return rod means comprises a pair of non-return rods respectively interconnecting said control lever means and said pair of rear sprockets.

13. The apparatus as set forth in claim 3, further comprising:

second spring-biasing means for biasing said front sprocket means toward a disengaged position with respect to said at least one thrust piston; and third spring-biasing means for biasing said rear sprocket means toward an engaged position with respect to said at least one thrust piston.

14. The apparatus as set forth in claim 13, wherein:

said second and third spring-biasing means comprise coil springs disposed about said at least one thrust piston.

* * * * *